US006352158B1

(12) United States Patent
Cole-Bennett et al.

(10) Patent No.: US 6,352,158 B1
(45) Date of Patent: Mar. 5, 2002

(54) UNIT DOSE BLISTER PACKAGE WITH KEYHOLE ASSISTED OPENING FEATURE

(75) Inventors: Beverly Lynette Cole-Bennett, Lititz, PA (US); John Edward Malloy, Jr., Bridgewater; Beth Ann McLellan Ruland, Milltown, both of NJ (US)

(73) Assignee: Warner Lambert Company, Morris Plains, NJ (US)

( * ) Notice: Subject to any disclaimer, the term of this patent is extended or adjusted under 35 U.S.C. 154(b) by 0 days.

(21) Appl. No.: 09/611,404

(22) Filed: Jul. 6, 2000

(51) Int. Cl.[7] ..... B65D 83/04
(52) U.S. Cl. ..... 206/532; 206/469
(58) Field of Search ..... 206/469, 528, 206/531, 532, 534, 538, 539

(56) References Cited

U.S. PATENT DOCUMENTS

| | | | |
|---|---|---|---|
| 2,125,318 | A | 8/1938 | Salfisberg |
| 3,695,417 | A | 10/1972 | Stoker, Jr. |
| 3,780,856 | A | 12/1973 | Braverman |
| 3,809,220 | A | 5/1974 | Arcudi |
| 3,835,995 | A | 9/1974 | Haines |
| 3,924,746 | A | 12/1975 | Haines |
| 4,011,949 | A | 3/1977 | Braber et al. |
| 4,096,945 | A | 6/1978 | Melton, Jr. et al. |
| 4,243,144 | A | 1/1981 | Margulies |
| 4,294,361 | A | 10/1981 | Margulies et al. |
| 4,316,541 | A | 2/1982 | Braverman et al. |
| 4,332,327 | A | 6/1982 | Frohwerk et al. |
| 4,398,634 | A | 8/1983 | McClosky |
| 4,398,635 | A | 8/1983 | Hirt |
| 4,506,789 | A | 3/1985 | Dlugosz |
| 4,537,312 | A | 8/1985 | Intini |
| 4,650,079 | A | 3/1987 | Tani |
| 4,720,011 | A | 1/1988 | Canamero |
| 4,724,982 | A | 2/1988 | Redmond |
| 4,762,230 | A | 8/1988 | Croce |
| 4,781,294 | A | 11/1988 | Croce |
| 4,890,744 | A | 1/1990 | Lane, Jr. et al. |
| 4,921,137 | A | 5/1990 | Heijenga |
| 4,923,063 | A | 5/1990 | Tararuj |
| 4,981,213 | A | 1/1991 | Dillon |

(List continued on next page.)

*Primary Examiner*—Jim Foster
(74) *Attorney, Agent, or Firm*—Barry H. Jacobsen

(57) ABSTRACT

A child-resistant blister package for unit dose products, e.g., medicaments, composed of a blister layer and a cover layer. The blister layer formed of a planar material, e.g., thermoformable or cold-formable webstock, and has plural intersecting perforated line to form plural cells contiguous with the perforated lines. Some or all of the cells of the blister layer have a peripheral planar flanged portion and a blister portion projecting from the flanged portion to form a cavity in which the unit dose product is located. The cover layer is formed of a planar material, e.g., aluminum or other metal foil in either a single layer or laminated, and has plural intersecting perforated line to form plural cells contiguous with those perforated lines. Each cell of the cover layer is the same shape and size as a corresponding cell of the blister layer. The cover layer is fixedly, e.g., adhesively, secured to the blister layer along the flanged portions, with the perforated lines of each being aligned and with the cells of the cover layer being coincident with the cells of the blister layer. A keyhole shaped opening is provided in each cell having a cavity of the blister layer. Each keyhole shaped opening includes an elongated, e.g., 3 mm linear, slit having a pair of ends and a hole, e.g., a 1 mm circular hole, at a first one of the pair of ends of the slit. Each keyhole shaped opening is located in its associated cell of the blister layer so that the first one of the ends of its slit is located adjacent but spaced by a small gap of a predetermined length, e.g., 1 mm, slightly from a perforated line forming an edge of the cell. The hole of each keyhole shaped opening is directed to but spaced, e.g., 4 mm, from the cavity of the associated cell.

27 Claims, 2 Drawing Sheets

U.S. PATENT DOCUMENTS 5,033,616 A 7/1991 Wyser
5,046,618 A 9/1991 Wood
5,088,603 A 2/1992 Kirkpatrick
5,123,539 A 6/1992 de Vries et al.
RE34,087 E 10/1992 Redmond
5,172,812 A 12/1992 Wharton et al.
5,242,055 A 9/1993 Pora
5,310,060 A 5/1994 Bitner et al.
5,325,968 A 7/1994 Sowden
5,339,960 A 8/1994 Price
5,358,118 A 10/1994 Thompson et al.
5,443,154 A 8/1995 Hustad et al.
5,469,968 A 11/1995 Matthews et al.
5,472,093 A 12/1995 Nugent et al.
5,511,665 A 4/1996 Dressel et al.
5,529,188 A 6/1996 Coggswell
5,551,567 A 9/1996 Malone et al.
5,613,609 A 3/1997 Hamilton et al.
5,727,687 A 3/1998 Renner
5,735,401 A 4/1998 Cassou et al.
5,758,774 A 6/1998 Leblong
5,775,505 A 7/1998 Vasquez et al.
5,785,180 A 7/1998 Dressel et al.
5,862,915 A 1/1999 Plezia et al.
5,878,887 A 3/1999 Parker et al.
5,878,888 A 3/1999 Faughey et al.
5,894,930 A 4/1999 Faughey et al.
5,899,333 A 5/1999 Williams et al.
5,908,113 A 6/1999 Takemasa et al.
5,938,032 A 8/1999 Svec et al.
5,944,191 A 8/1999 Ray et al.
6,199,698 B1 * 3/2001 Hetrick et al. ..... 206/532

* cited by examiner

UNIT DOSE BLISTER PACKAGE WITH KEYHOLE ASSISTED OPENING FEATURE

BACKGROUND OF THE INVENTION

This invention relates generally to packaging and more particularly to child-resistant blister packages.

Various packages have been disclosed in the patent literature and many are commercially available for holding one or more medicaments therein.

For example, U.S. Pat. No. 3,780,856 (Braverman) discloses a medicinal dispensing package comprising a base member having plurality of units, each made up of flanges having corners and surrounding a chamber for holding a drug therein. The units are detachably connected along perforated lines so that one flange may be separated from the others. A closure sheet having perforated lines corresponding to the perforated lines of the base member is secured, via areas of adhesive on it, to the flanges of the units to cover each unit. The central areas of the closure sheet disposed over each of the chambers do not have any adhesive. Selected comers of the base member are cut away so that one comer of the closure sheet overlying unit can be readily lifted as a tab to gain entry into the chamber.

In U.S. Pat. No. 4,398,634 (McClosky) there is disclosed a child-proof package system including multiple sealed units that are separately interconnected to one another by tear lines. Each of the units includes opposed, substantially planar, tear resistant flexible plastic sheets heat sealed to each other about peripheral seal zones to form a compartment for a drug. The seal zones between adjacent compartments include tear lines for permitting separation of discrete sealed units from each other without disrupting the integrity of the compartments. Each tear line includes a substantially linear, continuous slit uninterrupted by bridge areas and being linearly aligned with the compartments of adjacent units. The linear dimension of each of the continuous slits is greater than the greatest linear dimension of the linearly aligned compartments as measured parallel to the continuous slit.

In U.S. Pat. No. 5,551,567 (Malone et al.) there is disclosed a package having plural blister units, each of which includes a well adapted to hold a medicinal dosage therein. Score lines are surrounding each well to define the boundaries of each unit. A cover having plural score lines corresponding to the score lines of the blister is located over the blister to seal the dosage within the wells. Each of the units is separable from the other units by tearing it along its score lines. A short score line is provided in each blister unit and it extends into communication with the score lines separating the units. The short score line of each unit serves as the means for tearing an individual unit open to gain access to the dosage therein.

Other blister packages, some of which are disclosed to be "child-proof", are shown in the following United States Letters Patent Nos.: U.S. Pat. No. 4,011,949 (Braber et al.), U.S. Pat. No. 4,248,144 (Margulies), U.S. Pat. No. 4,294,361 (Margulies et al.), U.S. Pat. No. 4,398,635 (Hirt), U.S. Pat. No. 4,506,789 (Dlugosz), U.S. Pat. No. 4,537,312 (Intini), U.S. Pat. No. 5,046,618 (Wood), U.S. Pat. No. 5,172,812 (Wharton et al.), U.S. Pat. No. 5,310,060 (Bitner et al.), U.S. Pat. No. 5,325,968 (Sowden), U.S. Pat. No. 5,339,960 (Price), U.S. Pat. No. 5,469,968 (Matthews et al.), U.S. Pat. No. 5,472,093 (Nugent et al.), U.S. Pat. No. 5,529,188 (Coggswell), U.S. Pat. No. 5,613,609 (Hamilton et al.), U.S. Pat. No. 5,758,774 (Leblong), U.S. Pat. No. 5,775,505 (Vasquez et al.), U.S. Pat. No. 5,785,180 (Dressel), U.S. Pat. No. 5,862,915 (Plezia et al.), U.S. Pat. No. 5,878,887 (Parker et al.), U.S. Pat. No. 5,878,888 (Faughey et al.), U.S. Pat. No. 5,894,930 (Faughey et al.), U.S. Pat. No. 5,938,032 (Svec et al.) and U.S. Pat. No. 5,944,191 (Ray et al.)

While the packages of the foregoing patents may be generally suitable for their intended purposes, they each appear to leave something to be desired from the standpoint of providing a unt-dose package which is easy to open by an adult, but which is resistant to opening by a child (e.g., is "child-proof") is simple in construction and low in cost.

SUMMARY OF THE INVENTION

In accordance with one aspect of this invention there is provided a child-resistant blister package for unit dose products, e.g., medicaments. The package basically comprising a blister layer and a cover layer. The blister layer is formed of a planar material, e.g., thermoformable or cold-formable webstock, and has at least one perforated line and at least two cells or units contiguous with its perforated line. The cells of the blister layer have a peripheral planar flanged portion and a blister portion projecting from the flanged portion to form a cavity in which the unit dose product is to be located. The cover layer is formed of a planar material, e.g., aluminum or other metal foil in either a single ply or a lamination, and has at least one perforated line and at least two cells contiguous with its perforated line. Each cell of the cover layer is the same shape and size as a corresponding cell of the blister layer. The cover layer is fixedly, e.g., adhesively, secured to the blister layer along the flanged portions, with the at least one perforated line of the cover layer being coincident with the at least one perforated line of the blister layer and with the cells of the cover layer being coincident with the cells of the blister layer.

The blister layer additionally comprises a generally keyhole shaped opening in at least one of its cells. The keyhole shaped opening comprising an elongated, e.g., 3 mm, linear slit having a pair of ends and a hole, e .g., a 1 mm circular hole, at a first one of the pair of ends of the slit. The keyhole shaped opening is located in the cell of the blister layer so that the first one of said pair of ends is located adjacent but spaced by a gap of a predetermined length, e.g., approximately 1 mm, slightly from the at least one perforated line of the blister layer, and with the hole being located spaced, e.g., 4 mm, from but directed toward the cavity of that cell.

When so constructed the package is resistant to tearing by a child, but is tearable by an adult along the at least one aligned perforated lines and from there across the gap to the slit in the keyhole shaped opening.

DETAILED DESCRIPTION OF THE PREFERRED EMBODIMENT

Figure 1:
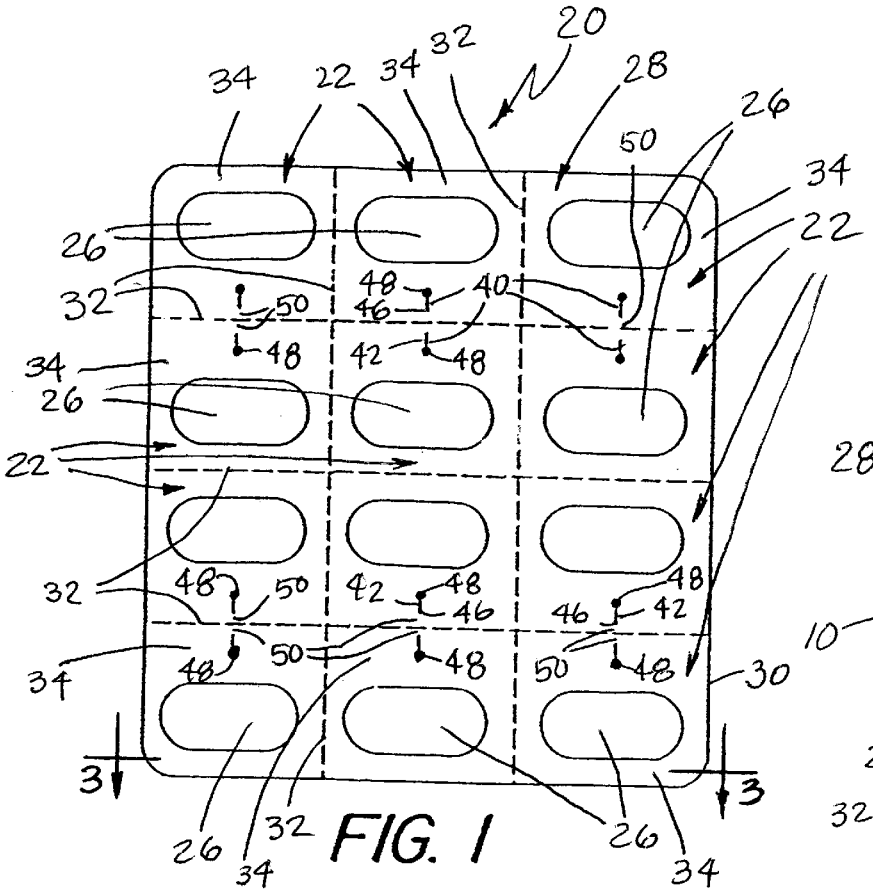
FIG. 1 is a top plan view of one exemplary embodiment of a child resistant blister package constructed in accordance with this invention.
Figure 2:
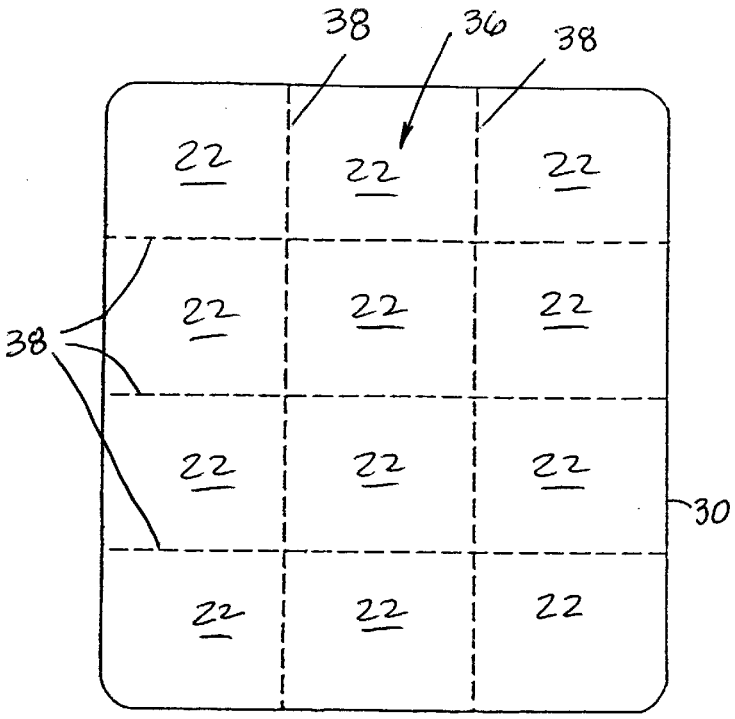
FIG. 2 is a bottom plan view of the embodiment of the package shown in FIG. 1.

Referring now to the various figures of the drawing wherein like reference characters refer to like parts, there is shown at 20 in FIG. 1 one embodiment of a package constructed in accordance with this invention. The package 20 provides a means for the delivery of unit-doses of medicaments 10 (FIG. 3) that is tamper-proof, child-resistant, yet readily openable by adults, airtight, uses conventional packaging materials, and is simple in construction and economical. As can be seen from the figures, the package 20 is of the "blister" type for holding individual dosages of the medicament 10 therein. Each dosage is separately packaged within its own unit or cell 22 for delivery to a patient. The cells 22 are releasably secured to each other by perforated lines (to be described later) so that any cell can be removed from the remaining cells of the package, and then opened to provide access to the medicament 10 within that cell.

In the exemplary embodiment of the package 20 shown herein there are twelve cells or units 22, in an array of three rows of four columns of like units. In this embodiment each of the twelve cells is identically constructed and each contains a unit-dose of the medicament 10 held in its own cavity 26 of a blister layer of material (to be described later) forming the package 20. If desired, the central two cells 22 may be blank so that only the ten peripherally located ones of the cells 22 of the array have a blister cavity 26 for containing a dose of the medicament. Thus, it should be noted at this juncture that the arrangement of cells shown in FIG. 1 is merely exemplary of any number of packages that may be constructed in accordance with this invention to include as many rows and columns of medicament containing cells 22 as desired.

The blister package 20 comprises of two layers of materials. The "top" layer, shown in FIG. 1, is a "blister" sheet 28 (FIGS. 1 and 3) formed of a substantially rigid material, e.g., any conventional thermoformed material used in blister packaging, such as plastic, or cold-formable materials, such as foils or plastics. Moreover, the material may be a single ply or mulitiple plies or laminations. In one preferred embodiment of this invention the top layer 28 is formed as a single ply of polyvinylchloride. In any case, the top layer 28, is a planar sheet of a generally rectangular shape having a peripheral marginal edge 30. The corners of the layer 28 are rounded in the interests of safety.

As best seen in FIG. 1, the top layer 28 includes a grid of plural perforated lines 32. The lines extend through the thickness of the layer 28, across its full width and height, and intersect one another at equidistantly spaced locations to define therebetween the respective medicament holding cells 22. As mentioned earlier the top layer includes respective cavities 26 for the medicaments 10. In particular, the top layer 28 includes a plurality of raised hollow projections or "blisters," each centered between the intersecting perforated lines 32 forming the cells 22. The portions of the top layer 28 within the confines of the intersecting perforated lines 32 of each of the cells 22 is in the form of a planar peripheral flange 34 surrounding the blister of that cell. Each of the blisters, being hollow, forms the heretofore identified cavity 26 within its interior.

Figure 3:
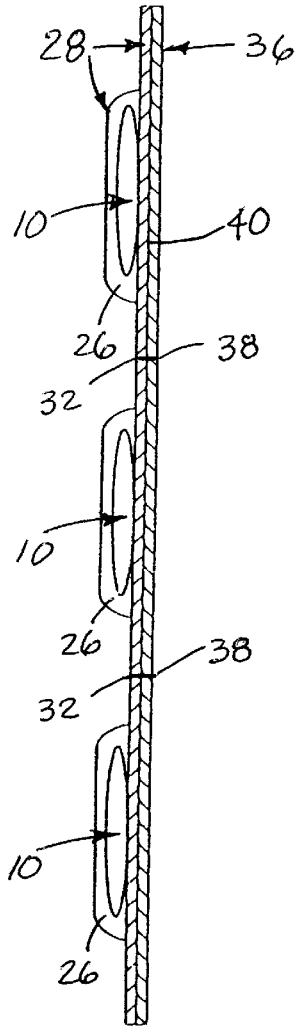
FIG. 3 is an enlarged sectional view taken along line 3—3 of FIG. 1.

In the embodiment shown herein each of the blisters is of a general flat oval shape as best seen in FIGS. 1 and 3. This shape is conducive for accommodating a capsule or caplet shaped medicament 10, like shown in FIG. 3. As will be appreciated by those skilled in the art the shape of the blisters or cavities 26 is purely a matter of choice, depending upon the shape of the medicament to be held therein. Thus, this invention contemplates packages having blisters or cavities of any geometrig shape and/or size, to accommodate medicaments which are round, caplet, gelcap, ultratab, oblong, rectangular, triangular, pentagonal, octagonal or any other geometrically feasible shape and/or size.

The top layer 28, with the medicaments 10 located in its cavities 26, is sealed by a closure sheet or bottom layer 36. The bottom layer 36 is a thin planar sheet of the same size and profile as the top layer 28 and can be formed of any suitable material(s), such as metal foil (e.g., aluminum), plastic, metalized film, and/or paper stock, in single or multiple plies or laminations of one or more of the foregoing. The bottom sheet includes a grid of plural intersecting perforated lines 38. The perforated lines 38 extend through the thickness of the layer 36, across its full width and height, and intersect one another at equidistantly spaced locations coincident with the perforated lines 32 of the top layer 28 to define therebetween the respective medicament holding units or cells 22. The bottom layer 36 is adhesively secured to the top layer 28 by an adhesive layer 40 (FIG. 3) at the interface of the top surface of the flanges 34 of the top layer 28 and the under-surface of the bottom layer 36.

The materials making up the top and bottom layers 28 and 36, respectively, are sufficiently tear-resistant that the package 20 is resistant to being torn apart or opened at places other than the coincident perforated lines 32 and 38. Even tearing the package along the perforated lines will not provide access to the medicament contents of any of the cells 22 (all it may do is to separate the particular cell 22, whose margins are formed by the perforated lines that are torn, from the remainder of the package). To gain access to the contents of the cavity of the selected cell 22 requires an additional or second tearing step. This second step is one that cannot be readily accomplished by a young child, but which can be readily accomplished by an adult by making use of a tear facilitating opening 40 (to be described hereinafter) in the top layer of that cell.

In particular, the top layer 28 includes a plurality of key-hole shaped, tear facilitating openings 40, one for each unit 22. Each tear-facilitating opening 40 comprises a short, e.g., 3 mm, linear slit 42 having a first end 46 and a second end at which a small, e.g., 1 mm, circular opening or hole 48 is located. Each opening 40 is located in the top layer 28 in the area forming a respective one of the cells 22, with the first end 46 of its slit 42 being located slightly spaced, e.g., 1 mm, inward of the perforated line 32 forming an inner marginal edge of the cell 22. This space forms a short bridgeable gap 50. The slit 42 is oriented so that it extends perpendicular to its associated perforated line 32. The circular opening 48 is located slightly spaced, e.g., 4 mm, from the cavity 26.

Figure 4:
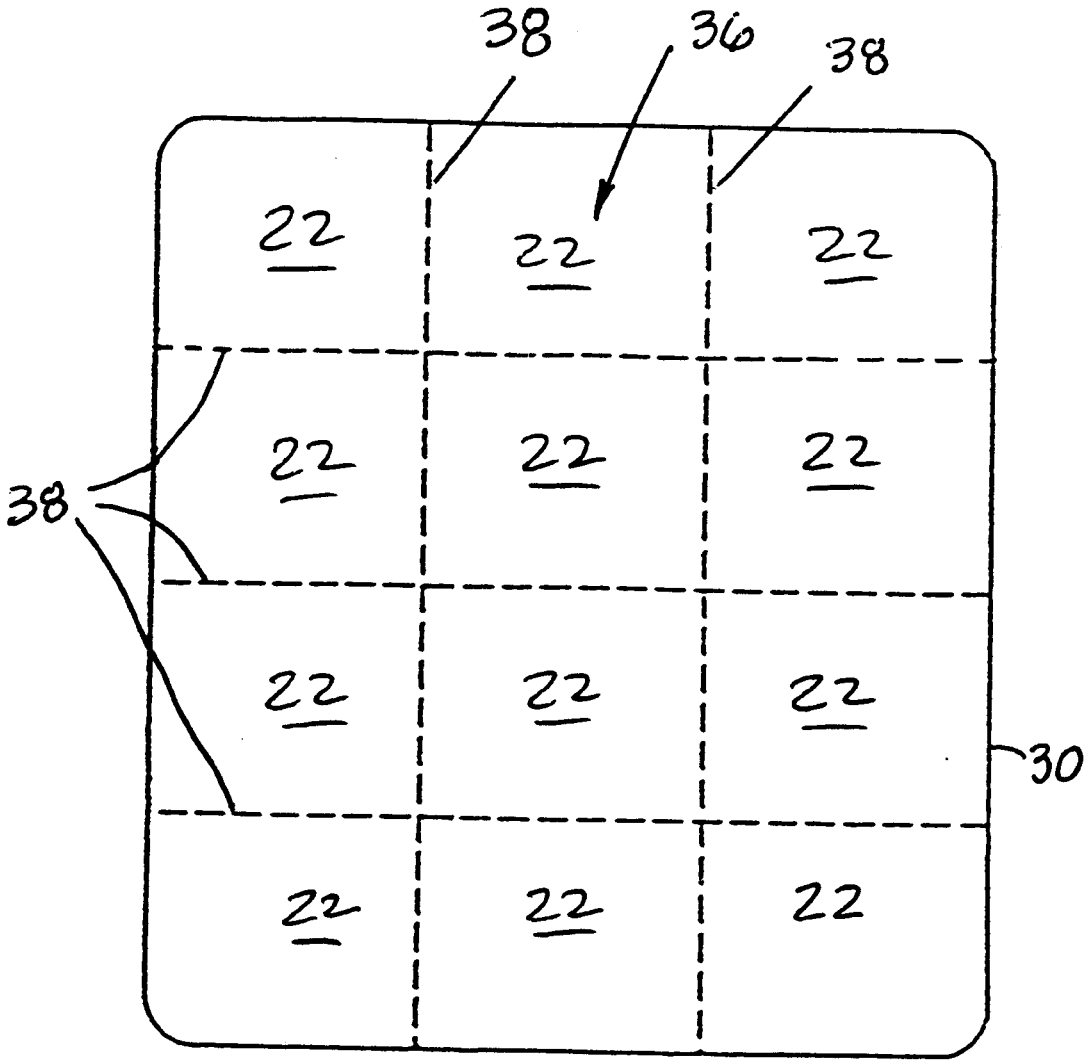
FIG. 4 is a bottom plan view of a second embodiment of the package.

As shown in FIG. 4, the tear-facilitating opening 40 can be included in the bottom layer 36 coincident to the tear-facilitating opening in the blister layer 28. However the child resistant features of the present invention can be accomplished by including the tear-facilitating opening 40 in only the blister layer 28.

In order to gain access to any of the cells 22, the perforated line defining one of the boundaries of that unit must first be torn. This action can be accomplished by tearing at least two intersecting perforated lines to physically separate the desired cell from the remainder of the package, or by tearing along only one perforated line to provide access to the cell, while still leaving the cell secured to one or more of the other cells of the package. In either case, once the line adjacent the tear facilitating opening 40 has been freed (torn) to provide access to a side of the cell 22 containing the medicament 10 to be dispensed, the cell's blister can be opened by tearing on its flange 34 contiguous with the gap 50. An adult will have the strength and coordination to breach the gap (tear the materials of the top and bottom layer along the length of the gap), a young child will not. Thus, a young child should not be able to open the blister to gain access to the medicament, even if the child is able to tear the cell 22 from the other cells of the package.

Once the gap 50 has been breached by the user tearing it, the tear propagates down the linear slit 42 to the circular opening 48 at the opposite end of the slit. Continued tearing on the cell 22 causes the tear to propagate in any radial direction from the opening 48 to the blister a short distance away, with the direction of the tear being dependent upon the direction of the tearing force applied by the user. The medicament can then be removed from the breached blister (cavity).

As should be appreciated by the foregoing the package of this invention is simple in construction, can be made economically, provides a protective environment for medicaments, and can be readily opened without the use of utensils, such as a scissors or knives. Moreover, owing to the fact that two tearing operations have to be accomplished to gain access to any of the medicaments in the package renders the package of the subject invention particularly suitable for limited access or child-resistant applications, e.g., holding medium to high toxicity drugs and the like.

Without further elaboration the foregoing will so fully illustrate our invention that others may, by applying current or future knowledge, adopt the same for use under various conditions of service.

We claim:

1. A child-resistant blister package for unit dose products, said package comprising a blister layer and a cover layer, said blister layer being formed of a planar material and having at least one perforated line and at least two cells contiguous with said perforated line of said blister layer, said cells having a peripheral planar flanged portion and a blister portion projecting from said flanged portion to form a cavity in which a product is to be located, said cover layer being formed of a planar material and having at least one perforated line and at least two cells contiguous with said perforated line of said cover layer, each cell of said cover layer being of the same shape and size as a corresponding cell of said blister layer, said cover layer being fixedly secured to said blister layer along said flanged portions, with said at least one perforated line of said cover layer being aligned with said at least one perforated line of said blister layer and with said cells of the cover layer being coincident with said cells of said blister layer, said blister layer additionally comprising a generally keyhole shaped opening in at least one of its cells, said keyhole shaped opening comprising an elongated slit having a pair of ends and a hole at a first one of said pair of ends of said slit, said keyhole shaped opening being located in said cell so that said first one of said pair of ends is located adjacent but spaced by a gap of a predetermined length slightly from said at least one perforated line, and with said hole being located directed toward said blister portion, said package being resistant to tearing by a child, but tearable by an adult along said at least one aligned perforated lines and from there across said gap to said slit of said keyhole shaped opening.

2. The package of claim 1 wherein said perforated line of said blister layer divides said blister layer into said at least two cells.

3. The package of claim 1 wherein said perforated line of said cover layer divides said cover layer into said at least two cells.

4. The package of claim 2 wherein said perforated line of said cover layer divides said cover layer into said at least two cells.

5. The package of claim 1 wherein said package has a peripheral edge and wherein none of said keyhole shaped opening is in communication with said peripheral edge.

6. The package of claim 1 wherein each of said slits is linear.

7. The package of claim 1 wherein each of said slits is approximately 3 mm long.

8. The package of claim 1 wherein said hole is circular.

9. The package of claim 8 wherein said circular hole is approximately 1 mm in diameter.

10. The package of claim 6 wherein said hole is circular.

11. The package of claim 10 wherein each of said slits is approximately 3 mm long and wherein said circular hole is approximately 1 mm in diameter.

12. The package of claim 1 wherein said hole of said keyhole shaped opening is located approximately 4 mm from said cavity.

13. The package of claim 11 wherein said hole of said keyhole shaped opening is located approximately 4 mm from said cavity.

14. The package of claim 1 wherein said gap is approximately 1 mm long.

15. The package of claim 11 wherein said hole of said keyhole shaped opening is located approximately 4 mm from said blister.

16. The package of claim 15 wherein said gap is approximately 1 mm long.

17. The package of claim 1 wherein said blister layer is formed of a thermoformable material.

18. The package of claim 17 wherein said thermoformable material is a plastic.

19. The package of claim 17 wherein said blister layer is formed of a coldformable material.

20. The package of claim 18 wherein said cold-formable material comprises a metal foil in a single or multiply plies or laminate.

21. The package of claim 18 wherein said cold-formable material comprises a plastic in a single or multiple plies or laminate.

22. The package of claim 1 wherein said cover layer comprises a metal foil in a single or multiple plies or laminate.

23. The package of claim 1 wherein said cover layer comprises a metalized film in a single or multiple plies or laminate.

24. The package of claim 1 wherein said cover layer comprises a plastic film in a single or multiple plies or laminate.

25. The package of claim 22 wherein said metal foil is aluminum.

26. The package of claim 1 wherein each of said blister portions is of a shape generally conforming to the shape of the product disposed within its chamber.

27. The package of claim 1 wherein said cover layer additionally comprises a generally keyhole shaped opening coincident to said generally keyhole shaped opening in said blister layer.

* * * * *